US005580528A

United States Patent [19]

Demers

[11] Patent Number: 5,580,528

[45] Date of Patent: Dec. 3, 1996

[54] BREAKAGE RESISTANT LABORATORY GLASSWARE ARTICLE

[76] Inventor: James P. Demers, 380 Riverside Dr., Apt. 6N, New York, N.Y. 10025

[21] Appl. No.: 406,655

[22] Filed: Mar. 20, 1995

Related U.S. Application Data

[63] Continuation of Ser. No. 182,632, Jan. 14, 1994.

[51] Int. Cl.[6] ..... B01L 3/02

[52] U.S. Cl. ..... 422/100; 422/102; 422/103; 222/46; 222/422

[58] Field of Search ..... 422/103, 100, 422/102; 222/46, 422

[56] References Cited

U.S. PATENT DOCUMENTS

| | | | |
|---|---|---|---|
| 3,268,300 | 8/1966 | Moran | 422/102 |
| 3,323,874 | 6/1967 | Phillips | 422/102 |
| 3,632,119 | 1/1972 | Carpenter | 277/26 |
| 3,695,642 | 10/1972 | DeWoody | 285/133 R |
| 3,836,334 | 9/1974 | Karamian | 422/100 |
| 4,055,498 | 10/1977 | Rodnoti | 210/94 |
| 4,391,779 | 7/1983 | Miskinis | 422/102 |
| 4,509,566 | 4/1985 | Phillips | 141/94 |
| 4,803,053 | 2/1989 | Williamson | 422/101 |
| 5,073,348 | 12/1991 | DeWoody | 422/101 |
| 5,156,812 | 10/1992 | Kilough | 422/102 |
| 5,215,717 | 6/1993 | Conant et al. | 422/102 |
| 5,268,150 | 12/1993 | Burkitt | 422/102 |

OTHER PUBLICATIONS

Cole–Parmer Instrument Co. 1993–1994 pp. 387–388 and p. 393.

Alfa Catalog 1993–1994, pp. 1163–1167.

Nalgene Labware Catalogue, 1992, pp. 90–91.

Kimble Glass Inc. Science Products Catalogue, 1993, pp. 52–53 and pp. 172–173.

Baxter Diagnostics Inc. Scientific Products Division General Catalogue, 1991–1992, p. 490.

Safe–Lab Inc. Catalog, 1987, pp. 97–98.

*Primary Examiner*—Nina Bhat

*Attorney, Agent, or Firm*—James P. Demers

[57] ABSTRACT

A breakage-resistant form of separatory funnel or other laboratory glassware, such as addition funnel, flask, buret, or chromatography column, is provided. The glassware features an unbreakable plastic stem, preferably removably attached, below the glass stopcock in place of the usual glass stem.

20 Claims, 1 Drawing Sheet

BREAKAGE RESISTANT LABORATORY GLASSWARE ARTICLE

This is a continuation of co-pending application Ser. No. 08/182,632 filed on Jan. 14, 1994.

FIELD OF THE INVENTION

This invention relates to articles of laboratory glassware that are rendered breakage-resistant by the incorporation of plastic components.

BACKGROUND OF THE INVENTION

A large class of laboratory glassware includes a glass vessel component, with one stem of a stopcock fused to the lower surface of the vessel such that the bore of the stopcock is contiguous with the interior of the vessel. Another stem of the stopcock serves as a drain through which some or all of the contents of the vessel may be emptied. Examples of this class of glassware are separatory funnels, addition funnels, burets, and certain reaction flasks that, due to their size or the complexity of connected apparatus, are preferably drained through a stopcock fused to the bottom surface.

The stems of the all-glass funnels, flasks, burets, and columns that are currently in use are vulnerable to being struck against bench tops and other objects and surfaces, both in the laboratory and in glassware washing facilities. The stresses resulting from such impacts usually fracture the glass just below the stopcock, or else chip off the end of the stem, which then becomes more vulnerable to further chipping. When the fracture is close to the stopcock, repair is impossible without replacing the stopcock, and it is usually more economical to discard the entire apparatus and purchase a replacement. Manufacturers of laboratory glassware have recognized this problem, and have made frequent attempts to find a solution.

Separatory funnels and burets are being marketed which are breakage-resistant by virtue of being entirely constructed of plastic. Although useful in a teaching laboratory where durability is a prime consideration, they have not been well-accepted by professional chemists, since they are not as transparent as glass, they are not as hard and thus are more easily scratched, and they are less resistant to chemicals.

Other attempts to solve the problem have involved the incorporation of plastic components into glass apparatus, and methods of attaching plastic components to glass apparatus are well-known in the art. The simplest type are friction-fitted connections, where mating plastic and glass parts are simply pressed together. One example involving an elastomeric grommet, which fits into an opening in a glass flask, and into which a plastic tube is inserted, is described in U.S. Pat. No. 3,268,300. Another more elaborate example is provided in U.S. Pat. No. 3,632,119, wherein a plastic fitting is inserted into a glass tube and held in place with polytetrafluoroethylene (PTFE)-clad compressed O-ring seals. The teachings of these two patents are incorporated herein by reference.

There have been burets and separatory funnels commercially available having friction-fitted removable stopcocks. For example, the 2116 buret series marketed by Corning Glass Inc., or the 17021 and 17121 buret and 29050 and 29053 funnel series marketed by Kimble Glass, Inc., incorporate a stopcock assembly, constructed of PTFE, friction-fitted between an upper glass vessel and a lower glass stem. In the case of the Kimble 17121 buret and 29053 funnel, the PTFE stopcock assembly is further attached to the glass vessel via a threaded nut.

Another method of attaching plastic components to glassware is through spirally threaded connections. Threaded glassware and associated plastic parts with mating threads are well-known in the art, and are available on many types of laboratory apparatus. For an example of glass fittings with female threads, and mating plastic connectors with male threads, see U.S. Pat. No. 3,695,642, the teachings of which are hereby incorporated by reference. The more common situation involves glass with male threads, as in a glass vial or bottle with a mating plastic cap. An example of the latter design applied to laboratory glassware is a plastic stem threaded to a glass filtration funnel, such as that sold by Safe-Lab, Inc., of Santee, Calif. under the SAFE-FRIT trademark. These filtration funnels incorporate a polypropylene stem, which is widened at the upper end and attached to the threaded lower portion of a cylindrical glass fritted funnel. The threaded portion of the polypropylene stem is as wide as the funnel itself, thus each size of funnel has a matching size plastic stem. These fritted funnels are used exclusively for filtration and do not incorporate stopcocks.

There exists a need, therefore, for articles of stopcock-equipped glassware that retain the advantages of glass, such as transparency, hardness, and chemical resistance, for both the vessel and the stopcock, without the disadvantage of fragility in the vulnerable stopcock stem. None of the presently available articles fulfill this need. All-plastic articles are less transparent than glass and are easily scratched, while articles with plastic stopcock bodies are opaque just where transparency is especially valuable.

SUMMARY OF THE INVENTION

The primary object of the present invention is to provide a solution to the problem of frequent breakage of the glass stems of conventional separatory funnels, and of other glass vessels with fragile stems attached to stopcocks.

As a solution to this problem, the present invention provides separatory funnels and other glass vessels with glass-bodied stopcocks, which have a breakage-resistant flexible stem in place of the usual glass stem. The flexible stem of the present invention cannot be chipped, and absorbs the energy of impacts, thereby reducing the stress transmitted to the glass in the region of the stopcock and greatly reducing the chance of breakage at the stopcock. The flexible stem of the present invention will withstand repeated impacts that would fracture glassware of conventional construction.

The invention takes the form of a glass apparatus for containing and dispensing liquids, featuring a stopcock for controlling the drainage of liquids from the apparatus. The stopcock body has a first stem and a second stem with interior portions, and a receiving portion containing a stopcock plug which can be moved and/or rotated within the stopcock body so as to control the dispensing of liquids from the apparatus. The apparatus includes a glass vessel defining an interior portion for containing the liquids, the vessel having a lower surface fused to the first stem so that the interior of the vessel is contiguous with the interior of the first stem. A means for affixing a portion of flexible tube is formed in the end of the second stem. This may provide a permanent attachment, or it may be a means of removably affixing the stem. The vessel can be of any shape, and may have one or more necks in its upper surface for introduction of liquids into the apparatus.

The glassware of the present invention retains the advantages of glass construction for the vessel and for the stopcock body, while the disadvantages of plastic construction are limited to the stem where they are of little consequence. A preferred embodiment of the present invention, wherein the flexible stem is removable, has an advantage over both all-glass and all-plastic one-piece construction, in that clearing of debris from a clogged stopcock is much easier with the stem removed.

The present invention has an advantage over the products with a PTFE stopcock assembly, in that it is constructed of fewer parts and therefore is less expensive to manufacture, and it has the further advantage of an unbreakable stem. Yet another advantage of the present invention, when used in a separatory funnel, is that it retains the transparent glass stopcock housing of the traditional design. This allows the operator to carry out an accurate separation of liquid phases, whereas in the items with a PTFE stopcock body this part of the apparatus is opaque and prevents observation of the interface between two liquid phases as it enters the stopcock.

Unlike the SAFE-FRIT filtering devices, the present invention provides a single size stem for all separatory funnels, burets, flasks, and columns in the laboratory, with the attendant savings in manufacturing, inventory, and purchase costs.

DETAILED DESCRIPTION OF THE PREFERRED EMBODIMENTS

Figure 1:
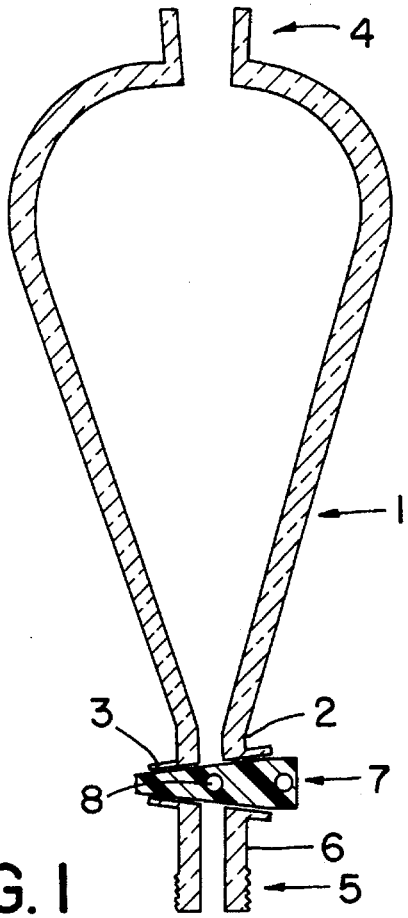
FIG. 1 is a cross sectional view of a Squibb type separatory funnel embodying the present invention, showing the integral glass-bodied stopcock with a rotatable stopcock plug in a closed position, and with a male thread for attaching the flexible stem.
Figure 3:
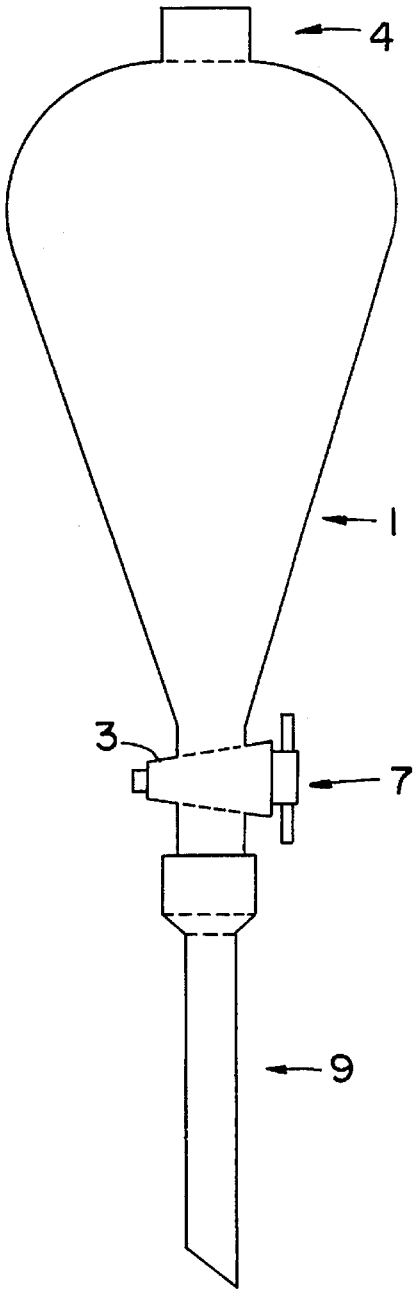
FIG. 3 is a side view of the assembled apparatus, with the stopcock plug shown in the open position.
Figure 2:
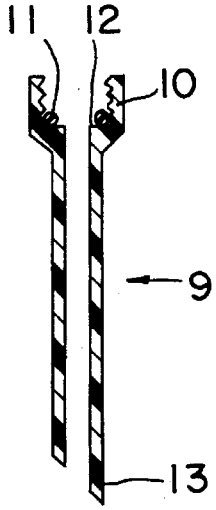
FIG. 2 is a cross-sectional view of the flexible stem, showing a mating female thread and an O-ring as the optional sealing element.

Turning to the drawings, wherein like numerals denote like components, FIGS. 1, 2, and 3 illustrate a preferred embodiment of the present invention.

The embodiment illustrated comprises a glass vessel 1, with the first stem 2 of a glass stopcock body 3 fused to the lower surface of the vessel 1 so that the interior of the vessel I is contiguous with the interior of the first stem 2. A neck 4 in the upper surface of the vessel 1 provides an opening for introduction of liquids. A means of attaching a flexible stem is a male thread 5, formed at the end of the second stem 6 of the stopcock. In a preferred embodiment, a stopcock plug 7 defines a bore 8 for controlling the dispensing of liquid from the apparatus, and rotation of the plug 7 within the stopcock body 3 brings the bore 8 into alignment with the interior portions of the stopcock body stems 2 and 6.

Affixable to the end of the second stem 6 is a flexible stem 9, which takes the form of a tube portion made of a moderately flexible material such as a plastic or other synthetic resin. A means of affixing the flexible stem 9 is a female thread 10 formed in the upper end. A compressible O-ring sealing element 11 is located within the threaded region 10 of the flexible stem 9, on an internal annular shoulder 12 where the end of the glass thread 5 will contact the flexible stem 9 when the apparatus is assembled as in FIG. 3. The lower end of the flexible stem 9 is cut at about a 45° angle to provide a drip tip 13.

The flexible stem is preferably removably affixed, and the preferred method of attachment is through mating spirally threaded regions 5 and 10. An optional elastomeric sealing element such as the O-ring 11 forms a seal between the glass and the flexible stem. A flat gasket could also be used for a sealing element. The liquid passing through the apparatus will not ordinarily be under pressure, so leakage through the joint between the end of glass thread 5 and the shoulder 12 will be minimal and a sealing element will usually not be required. In cases where reactive, radioactive, or toxic materials are to be handled, or where pressure or vacuum would result in unacceptable leakage, the sealing element will preferably be in place. The practitioner will select the appropriately sized gasket or O-ring, formed of an appropriately chemical resistant material, from the wide variety of commercially available products.

In one embodiment of the invention, the apparatus is a separatory funnel. The separatory funnel may be of any shape, for instance spherical, pear-shaped, or cylindrical. In another embodiment, the apparatus is a buret, while in a third embodiment, the apparatus is an addition funnel. In yet another embodiment, the apparatus is a reaction flask. Those skilled in the art of synthetic chemistry will appreciate that reaction flasks, especially those of about ten liters capacity or more, are often equipped with a stopcock drain on their lower surface, and these flasks are frequently used as separatory funnels as well as reaction flasks. The difference in configuration between one of these flasks and an ordinary separatory funnel lies in the former having multiple inlets or necks, while the latter has the single neck 4 shown in the drawings. In operation, the contents of a separatory funnel are usually shaken while the contents of a reaction flask are stirred mechanically.

Assembly of the apparatus of the present invention is within the ability of a glassblower skilled in the art of making scientific glassware. Glass-bodied stopcocks are articles of commerce in the scientific glassware industry, as for example the 41004 series sold by Kimble Glass, and vessels with the stopcock already attached are of course commercially available as well. Those skilled in the art will appreciate that although the straight bore stopcock shown in the figures represents the most common design, other types of glass-bodied stopcocks are available, for example that sold by Corning Glass under the trademark ROTAFLO, and glassware incorporating those designs is contemplated to be within the scope of this invention. Likewise, the incorporation of glass-bodied stopcocks with plugs made of various materials, such as glass and PTFE, are within the scope of this invention.

In the most preferred embodiment of this invention, the threads on the glass are male, and the threads on the flexible stem are female. The machining or forming of male threads on glass tubing is an operation known to those skilled in the art; the forming of female threads in plastic may be accomplished by machining or more economically on a large scale by molding. The preferred embodiment of male threads on the glass provides for inexpensive manufacture. It also provides a more durable product, because the fragile glass end of the assembled apparatus is sheathed within the flexible stem and protected from impact.

Other methods of attachment, including but not limited to those described in the background section above, will be apparent to those skilled in the art and are contemplated to be within the scope of this invention. For instance the glass vessel could have female threads and the flexible stem could have male threads, or the flexible stem could be pressed into or over a short tubular glass stem and held in place by friction, by compressed O-rings, by a grommet, or by annular ridges in the glass and/or in the flexible stem. The flexible stem could also be held in place by a separate fastener, having male or female threads and an axial opening for the flexible stem.

Regardless of the attachment means, it is preferable that the length of the second stem of the stopcock body, i.e. the distance between the stopcock plug 7 and the attachment means, is as short as can be conveniently manufactured, so as to maximize the strength of the assembled apparatus. The total length of the second stem 6 together with the attachment means is preferably about 4 cm or less, and most preferably about 2 cm or less.

The flexible material from which the flexible stem 9 is constructed is preferably resistant to common laboratory chemicals. The material must have sufficient rigidity to remain attached to the glass, and must be resilient enough to retain its shape after moderate deformation. Examples of suitable materials are polyethylene, polypropylene, polymethylpentene (PMP), polyphenylenesulfone, polycarbonate, poly(vinylidene difluoride) (PVDF), poly(tetrafluoroethylene) (PTFE), poly(fluorinated ethylene propylene) (FEP), polyetheretherketone (PEEK), poly(chlorotrifluoroethylene) (CTFE), polyamides (e.g. Nylon), and acetal resins (e.g. that sold by Du Pont under the trademark DELRIN). The most preferred materials are polyethylene, polypropylene, CTFE, FEP, and PTFE. Polyethylene and polypropylene are the most preferred materials for general use. In applications where chemical resistance is of primary importance, the preferred materials are CTFE, FEP, and PTFE, most preferably PTFE.

The flexible stem 9 is semi-rigid, i.e. it is rigid enough to absorb the impact of the apparatus being dropped on the flexible stem 9 without the stem 9 collapsing, but it is not so rigid so as to transmit enough of the energy of the impact to the glass stopcock stem 6 to cause breakage of the glass portion of the apparatus. A range of degrees of flexibility and resilience for the flexible stem 9 is contemplated to be within the scope of the present invention. With one end of the flexible stem 9 fixed in place, application of a force of one pound to the other end, along a direction perpendicular to the long axis of the stem, will preferably result in a deformation of from about 0.5% to about 20% of the length of the stem, most preferably from about 5% to about 10%.

The dimensions of the flexible stem 9 are determined by the size and mass of the apparatus and the mechanical properties of the material from which the stem is constructed. The preferred length of the flexible stem 9 is from about 3 cm to about 15 cm, more preferably from about 4 cm to about 10 cm. The preferred internal diameter is from about 0.5 to about 1.5 cm, except that where the apparatus is a buret the preferred internal diameter is preferably about 1 mm. The preferred outside diameter, excluding the means for attachment, is from about 0.7 to about 2.0 cm, except that where the apparatus is a buret the preferred outside diameter is about 0.5 cm. In general, the internal diameter of the flexible stem 9 will be about the same as the internal diameter of the second stem 6 so as to provide smooth flow of liquid from the apparatus.

To aid in assembly and disassembly of the apparatus, all or part of the external surface of the flexible stem 9 may be knurled, ridged, or otherwise given a rough surface, or given a non-circular cross-section, so as to provide a good grip.

Various other changes and modifications of the apparatus described above will be apparent to those versed in the art, and such changes can be made without departing from the scope of the present invention.

EXAMPLE

A 250-ml "Squibb style" separatory funnel with PTFE stopcock plug (Lab Glass Inc., Vineland, N.J., catalog No. 8421T-106) was obtained, and the stem below the stopcock was cut off to leave about 2.0 cm remaining. The cut end was heated with a glassblower's torch, and a standard GPI 13-425 male thread was then pressed into the soft glass with the appropriate tool. The resulting piece was similar to what is depicted in FIG. 1. In preparing a flexible stem, a cylindrical piece of polypropylene, 8.0 cm long and 1.6 cm in diameter, was drilled lengthwise to leave a 7 mm bore. Along the first 6.5 cm of the resulting tube, the outside diameter was reduced on a lathe to leave a hollow cylinder of 9 mm outside diameter. Within the last 1 cm, retaining the 1.6 cm outside diameter, a female GPI 13-425 thread was machined into the inner surface, and the opposite end of the tube was then cut at a 45° angle. The resulting piece was similar to what is depicted in FIG. 2. The polypropylene stem was threaded onto the glass separatory funnel, and the resulting apparatus was found to survive repeated forceful strikes of the flexible stem against a hard surface. The apparatus was also dropped repeatedly from a height of three feet onto a linoleum floor and onto a laboratory bench without breakage, so long as the initial impact was received by the flexible stem.

INDUSTRIAL APPLICABILITY

The apparatus of the present invention is useful for manipulating liquids in a laboratory, in that it provides a vessel which can contain a liquid on a temporary basis, for purposes of chemical reaction, mixing, measurement, separation, or storage, and from which the liquid can be drained in a controlled manner. The apparatus of the present invention is useful wherever separatory funnels, burets, reaction flasks, and chromatography columns are used, for instance in chemical and biological laboratories. The present invention provides sturdier versions of these items which are much less susceptible to breakage, and will reduce laboratory operating expenses.

What is claimed is:

1. A glass apparatus for containing and dispensing liquids comprising a stopcock plug defining a bore for controlling the dispensing of liquids from said apparatus;

a glass stopcock body defining a receiving portion containing the stopcock plug, the stopcock plug being rotatable within said receiving portion;

said stopcock body including a first stem and a second stem, said stems defining interior portions;

said glass apparatus including a glass vessel defining an interior portion for containing the liquids, said glass vessel having a lower surface fused to the first stem so that the interior portion of the vessel is contiguous with the interior portion of the first stem; and a male spiral thread formed in the end of the second stem wherein the total length of the second stem is about 4 cm or less.

2. The apparatus of claim 1 wherein the apparatus is a buret.

3. The apparatus of claim 1 wherein the apparatus is a reaction flask.

4. The apparatus of claim 1 wherein the apparatus is a separatory funnel.

5. The apparatus of claim 1, further comprising a flexible tube portion for dispensing liquid released through the second stem of the stopcock body, said tube portion having a female spiral thread formed in one end for releasably affixing the flexible tube portion to the end of the second stem.

6. The apparatus of claim 5 wherein the apparatus is a buret.

7. The apparatus of claim 5 wherein the apparatus is a reaction flask.

8. The apparatus of claim 5 wherein the apparatus is a separatory funnel.

9. A separatory funnel comprising a stopcock plug defining a bore for controlling the drainage of liquids from said separatory funnel;

a glass stopcock body defining a receiving portion containing the stopcock plug, said stopcock body including a first stem and a second stem, said stems defining interior portions;

a glass vessel defining an interior portion for containing the liquids, said glass vessel having an upper surface with a neck for introduction of liquids, and a lower surface fused to the first stem of the stopcock body so that the interior portion of the vessel is contiguous with the interior portion of the first stem; and a male spiral thread formed in the end of the second stem wherein the total length of the second stem is about 4 cm or less.

10. The separatory funnel of claim 9, further comprising a flexible tube portion for dispensing liquid released through the second stem of the stopcock body, said tube portion having a female spiral thread formed in one end for releasably affixing the flexible tube portion to the end of the second stem.

11. A glass apparatus for containing and dispensing liquids comprising:

a stop cock plug for controlling the dispensing of liquids from said apparatus;

a glass stopcock body defining a receiving portion containing the stopcock plug, said stopcock body including a first stem and a second stem, said stems defining interior portion;

said glass apparatus including a glass vessel defining an interior portion for containing the liquids, said glass vessel having a lower surface fused to the first stem so that the interior portion of the vessel is contiguous with the interior portion of the first stem; and a means for affixing a flexible tube formed in the end of the second stem wherein said means for affixing the flexible tube is selected from the group consisting of: a spiral thread, compressed O-rings, a grommet, and annular ridges;

wherein the total length of the second stem together with the affixing means is about 4 cm or less.

12. The apparatus of claim 11, wherein the apparatus is buret.

13. The apparatus of claim 11, wherein the apparatus is a reaction flask.

14. The apparatus of claim 11, wherein the apparatus is a separatory funnel.

15. The apparatus of claim 11, wherein the means for affixing the flexible tube is a spiral thread.

16. The apparatus of claim 15, further comprising a flexible tube portion for dispensing liquid dispensed through the second stem of the stopcock body, said tube portion having spiral thread formed in one end for releasably affixing the flexible tube portion to the end of the second stem.

17. The apparatus of claim 11, wherein the means for affixing a flexible tube is compressed O-rings.

18. The apparatus of claim 11, wherein the means for affixing the flexible tube is a grommet.

19. The apparatus of claim 11, wherein the means for affixing the flexible tube is annular ridges.

20. The apparatus of claim 11, further comprising a flexible tube portion for dispensing liquid dispensed through the second stem of the stopcock body.

* * * * *